US006070925A

United States Patent [19]

Moldofsky

[11] Patent Number: 6,070,925

[45] Date of Patent: Jun. 6, 2000

[54] TENT ASSEMBLY FOR USE WITH A VEHICLE

[76] Inventor: Lanny Moldofsky, 22940 Long Grove Rd., Barrington, Ill. 60010

[21] Appl. No.: 08/939,049

[22] Filed: Sep. 26, 1997

[51] Int. Cl.[7] ..... B60P 3/345

[52] U.S. Cl. ..... 296/26.08; 296/159; 296/161; 296/165; 296/167; 135/88.13

[58] Field of Search ..... 296/159, 161, 296/166, 165, 167, 26.08, 26.12; 135/88.13, 88.14, 88.16

[56] References Cited

U.S. PATENT DOCUMENTS

| | | | |
|---|---|---|---|
| 2,358,446 | 9/1944 | Couse . | |
| 3,649,063 | 3/1972 | Stark . | |
| 3,840,266 | 10/1974 | Carlson | 296/166 |
| 3,863,977 | 2/1975 | Hardinge . | |
| 3,923,336 | 12/1975 | Price, Sr. . | |
| 3,968,809 | 7/1976 | Beavers . | |
| 4,504,049 | 3/1985 | Straub | 296/265 |
| 4,544,195 | 10/1985 | Gunn | 296/165 X |
| 4,979,532 | 12/1990 | Johansson et al. . | |
| 5,018,778 | 5/1991 | Goble . | |
| 5,358,298 | 10/1994 | Fate | 296/161 X |
| 5,641,192 | 6/1997 | Smith et al. . | |
| 5,738,130 | 4/1998 | Thomas | 135/88.13 |

*Primary Examiner*—Joseph D. Pape
*Attorney, Agent, or Firm*—Meroni & Meroni; Charles F. Meroni, Jr.

[57] ABSTRACT

A tent assembly includes a plurality of support members connected to one another to form a frame. Covering material is removably connected with the frame to enclose an area. A sleeve structure is connected to the covering material with flexible sidewalls of the sleeve structure extending outwardly. The sidewalls define a sleeve opening adapted for enveloping the rear portion of the vehicle for removable telescoping engagement therewith. Compressible material is connected to outer edges of the sleeve structure for flexibly and resiliently engaging the rear portion of the vehicle so that the compressible material is compressed against the rear portion of the vehicle to form a seal to prevent the ingress of water and insects.

12 Claims, 8 Drawing Sheets

TENT ASSEMBLY FOR USE WITH A VEHICLE

BACKGROUND OF THE INVENTION

1. Field of the Invention

The present invention relates generally to tents and vehicle attachments. More particularly, the invention pertains to a tent assembly for use in combination with a vehicle and a method of using same.

2. Description of the Prior Art

Various types of vehicle tents are known in the art. For example, it has been common to provide a tent structure which is mounted in the cargo space of a pickup truck. Typical prior art patents which show tent structures for pickup cargo spaces can be seen in U.S. Pat. No. 5,018,778 issued to Goble and U.S. Pat. No. 3,649,063 issued to Stark.

Still other vehicle tents have been proposed for use with a vehicle which provide a tent structure which connects from the back a vehicle. For example, U.S. Pat. No. 3,863,977 issued to Hardinge discloses a collapsible shelter adapted to be supported by the back of vehicle. U.S. Pat. No. 3,968,809 issued to Beavers discloses a tent structure connectable with a van having hanger brackets mountable on the upper rear outside comers of the van.

In recent years the use of sport utilities vehicles have greatly increased. Accordingly, it would be desirable to have a tent assembly connectable with such vehicles which would be adapted to connect with vehicles of various sizes or shapes without requiring permanently installed equipment to be attached to the vehicle. Further, such assembly should adapted to provide a sealed connection with the vehicle to prevent the ingress of insects, water or debris into the enclosure defined by the tent assembly.

As will be described in greater detail hereinafter, the vehicle tent assembly and method of using same of the present invention solves the aforementioned problems and employs a number of novel features that render it highly advantageous over the prior art.

SUMMARY OF THE INVENTION

Accordingly, it is an object of this invention to provide an improved vehicle tent assembly and connection therebetween which is adapted to accommodate vehicles of various sizes and shapes and prevents the ingress of insects, water, or debris into an enclosure defined by the assembly.

Another object of this invention is to provide a tent assembly that is lightweight, collapsible and can be inexpensively manufactured.

Still another object of this invention is to provide a tent assembly which can be easily assembly and disassembled by a single user and allows the vehicle to be readily connected and disconnected therewith.

To achieve the foregoing and other objectives, and in accordance with the purposes of the present invention a tent assembly is provided for connection with a rear portion of a vehicle. The tent assembly includes a plurality of support members connected to one another to form a frame. Covering material is removably connected with the frame to enclose an area. A sleeve structure is connected to the covering material with flexible sidewalls of the sleeve structure extending outwardly. The sidewalls defining a sleeve opening adapted for enveloping the rear portion of the vehicle for removable telescoping engagement therewith. Compressible material is connected to outer edges of the sleeve structure for flexibly and resiliently engaging the rear portion of the vehicle so that the material is compressed against the rear portion of the vehicle to form a seal to prevent the ingress of water, insects or debris.

Other objects, features and advantages of the invention will become more readily apparent upon reference to the following description when taken in conjunction with the accompanying drawings, which drawings illustrate several embodiments of the invention.

DETAILED DESCRIPTION OF THE PREFERRED EMBODIMENT

Figure 1:
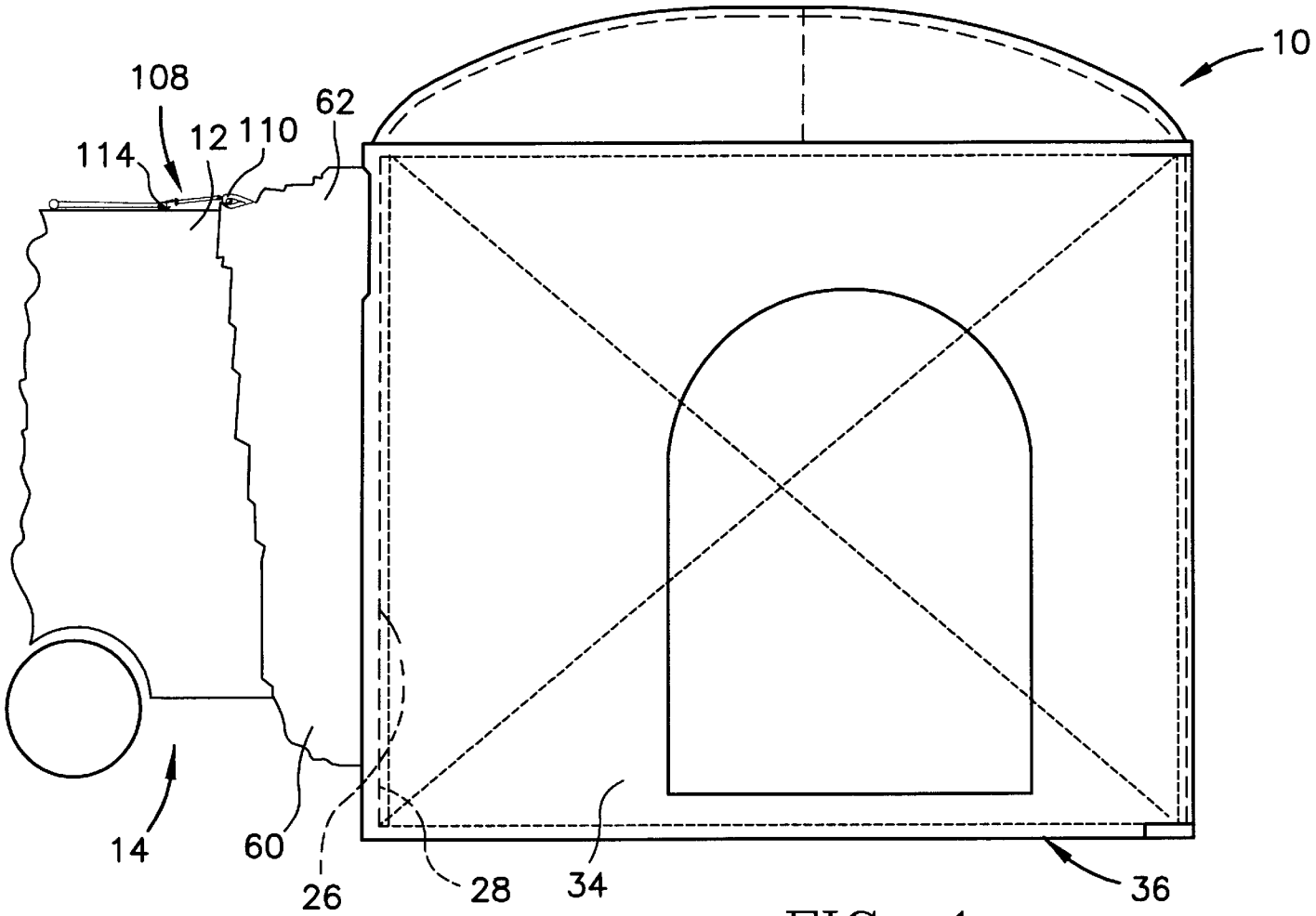
FIG. 1 is a side view of the tent assembly of the present invention.

Referring now to the drawings, a tent assembly 10 is illustrated in FIG. 1. The tent assembly 10 as hereafter disclosed is adapted for connection with a rear portion 12 of a vehicle 14 to allow a user access therebetween.

Figure 2:
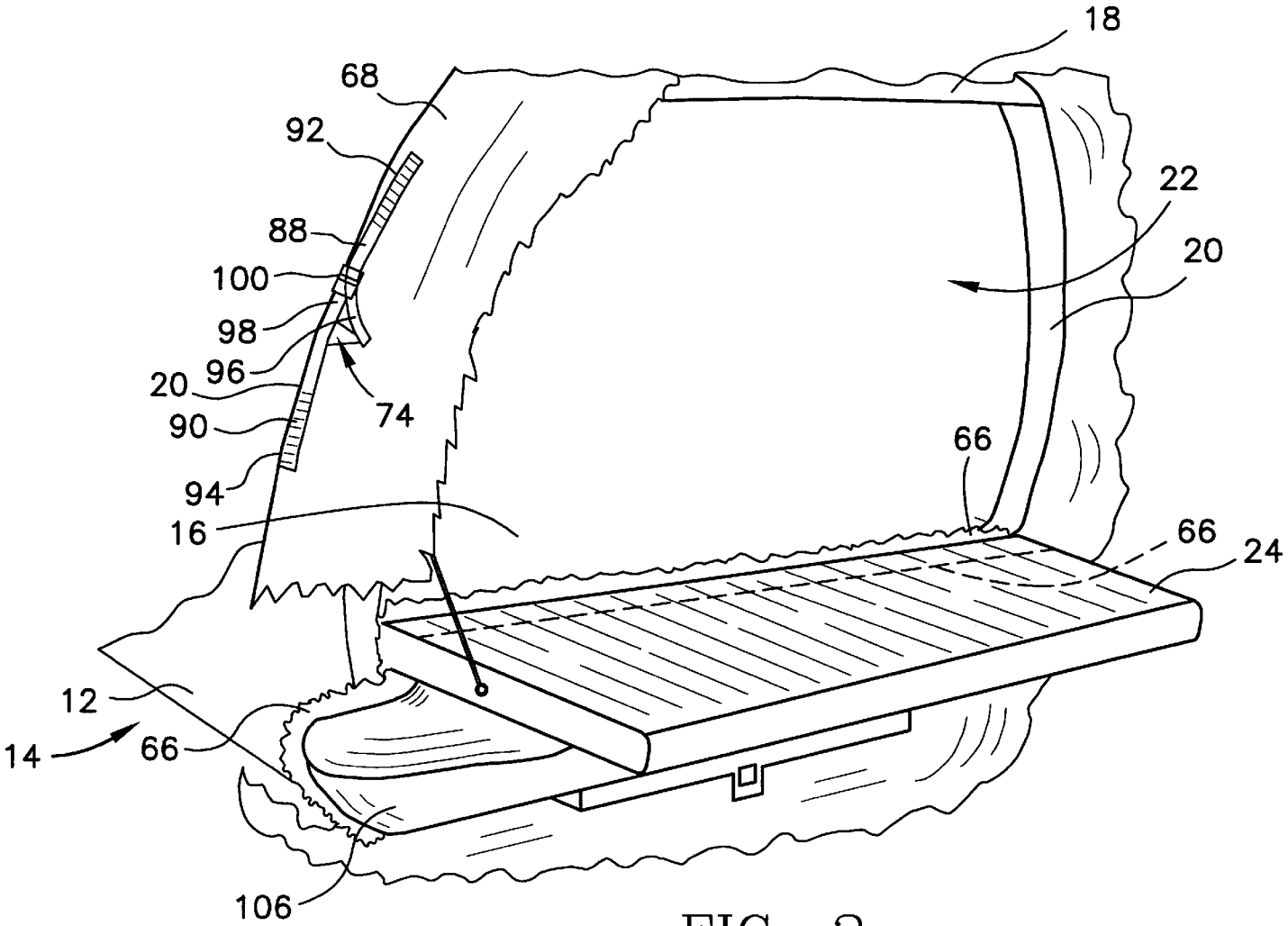
FIG. 2 is a perspective view of a rear portion of a vehicle illustrating a sleeve structure shown in partial view in telescoping engagement therewith.

Referring to FIGS. 1 and 2, the vehicle 14 is preferably of the type known as a sport utility vehicle which has a floor 16, roof 18 and sidewalls 20 defining a rear exit or opening 22 having a door member 24 hingedly secured thereto. The door member 24 typically comprises a tailgate or small door. It should be understood that the vehicle 14 could also be of the class of automobiles having rear exits, such as station wagons, or alternatively a van, minivan or pickup truck having a cargo space enclosed with cap or a pickup cargo tent of those known in the prior art. Accordingly, it is a desirable feature of this invention to provide a tent assembly 10 that is configured for connection with a wide variety of vehicles of varied sizes and shapes.

Figure 4:
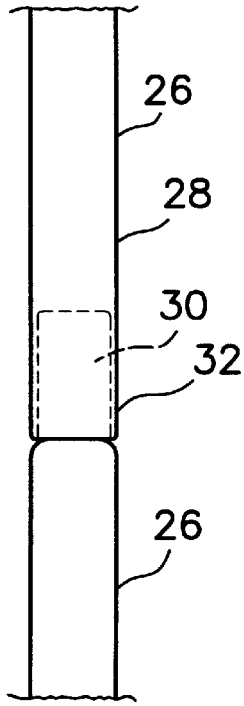
FIG. 4 is a side view of support members of a frame of the tent assembly.

Referring to FIGS. 2 and 4, the tent assembly 10 includes a plurality of support members 26 removably connected to one another to form a frame 28. The support members 26 in one preferred embodiment are formed of plastic or metal and are tubular shaped. A first end 30 of one support members is inwardly tapered for telescoping engagement with a second end 32 of another support member, as illustrated in FIG. 4. However, it may be appreciated that other types of frame construction known in the tent art may be employed with the present invention.

Figure 7:
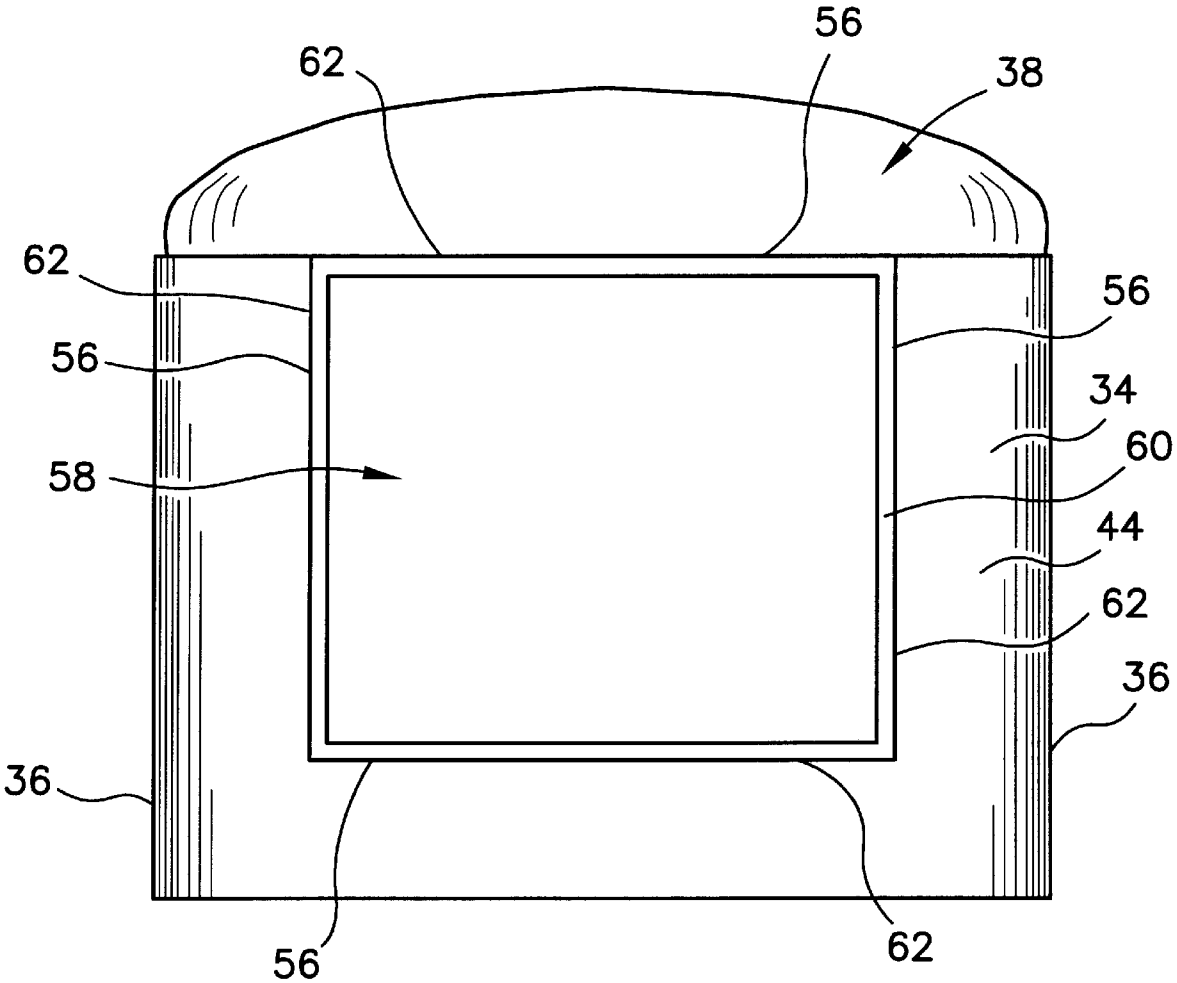
FIG. 7 is an back end view of the tent assembly.
Figure 8:
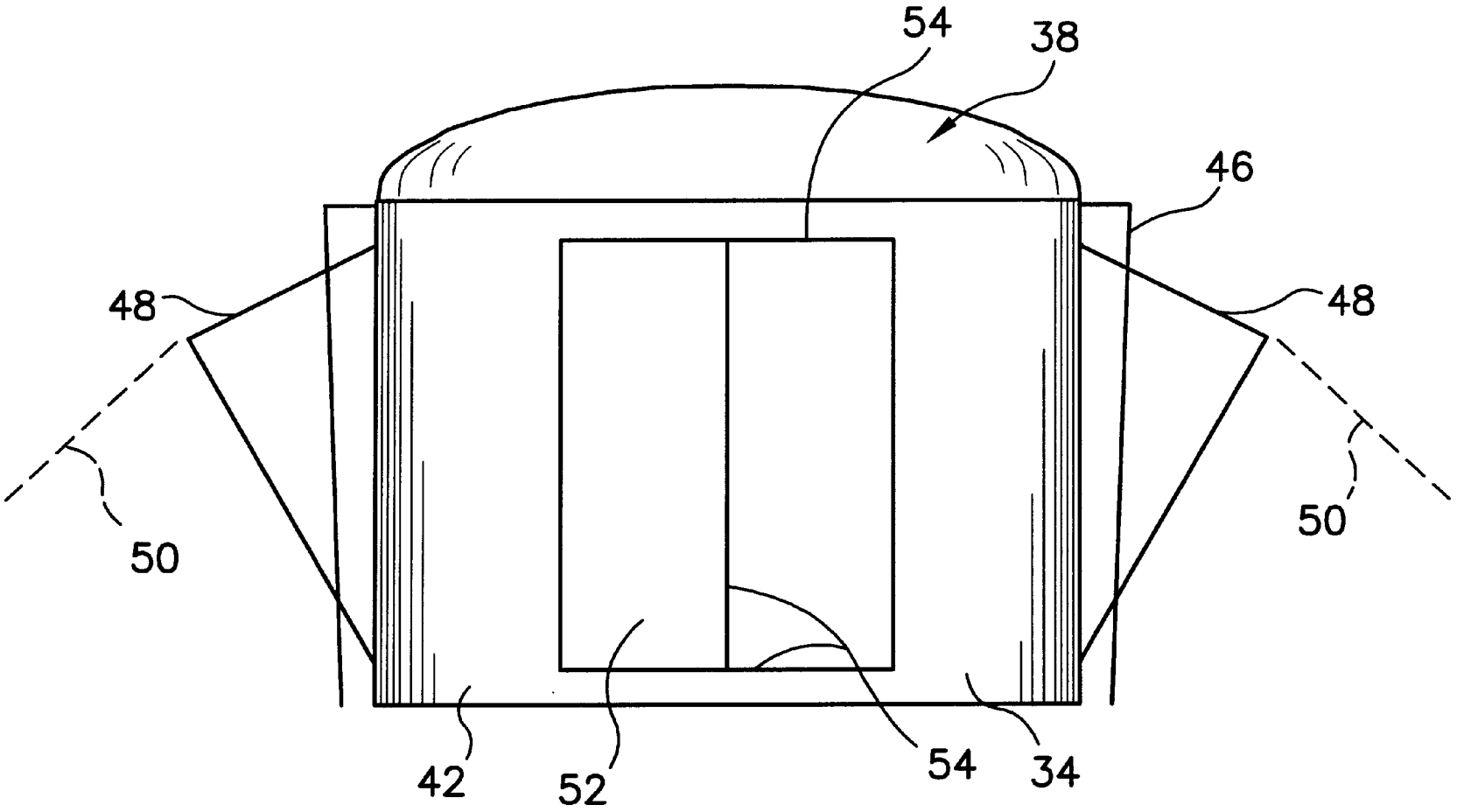
FIG. 8 is a front end view of the tent assembly.

Referring to FIGS. 1, 7 and 8, a covering material 34 formed of canvas, nylon or other suitable material is removably connected with the frame 28 to enclose an area 36 generally bordered by the frame 28. It should be understood that the frame 28 may be disposed to the inside or outside of the covering material 34. The covering material 34 when secured to the frame 28 provides sidewalls 36, a top 38, bottom 40, front wall 42 and back wall 44. Referring to FIG. 8, an awning 46 of conventional design may be secured with the assembly 10. Storm flaps 48 are connected with opposite sidewalls 36 and are extended outwardly and are secured with guide lines 50. A screen and water proof door 52 of conventional design in the tent art is provided and connected to the front wall with zippers 54.

Referring to FIG. 7, the back wall 44 of the covering material 34 is generally vertically oriented and has edges 56 defining a tent opening 58. A sleeve structure 60 formed of flexible canvas, nylon or other suitable material is connected to the covering material 34 and extends about the edges 56 of the opening 58. The sleeve structure 60 has flexible sidewalls 62, as shown in FIG. 1, which extend outwardly from the back wall 44. The sidewalls 62 define a generally square or rectangularly shaped sleeve opening 64 (FIG. 5) adapted and sized for enveloping the rear portion 12 of the vehicle 14 for removable telescoping engagement therewith, as also illustrated in FIG. 2.

Figure 3:
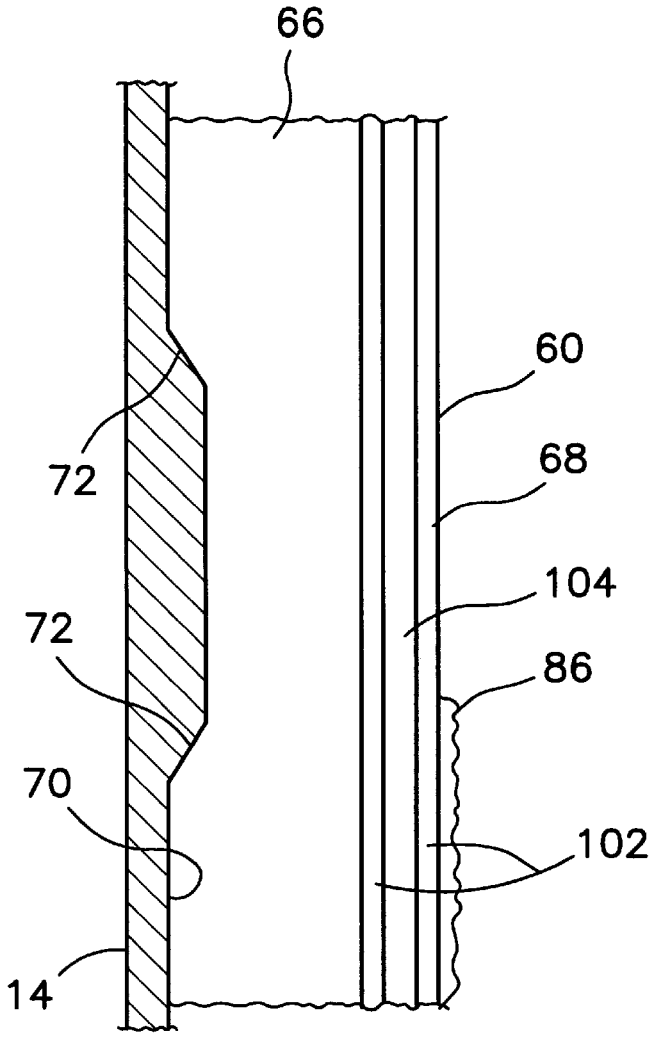
FIG. 3 is a side view of the sleeve structure illustrating compressible material of the sleeve structure in engagement with an outer surface of the vehicle.
Figure 5:
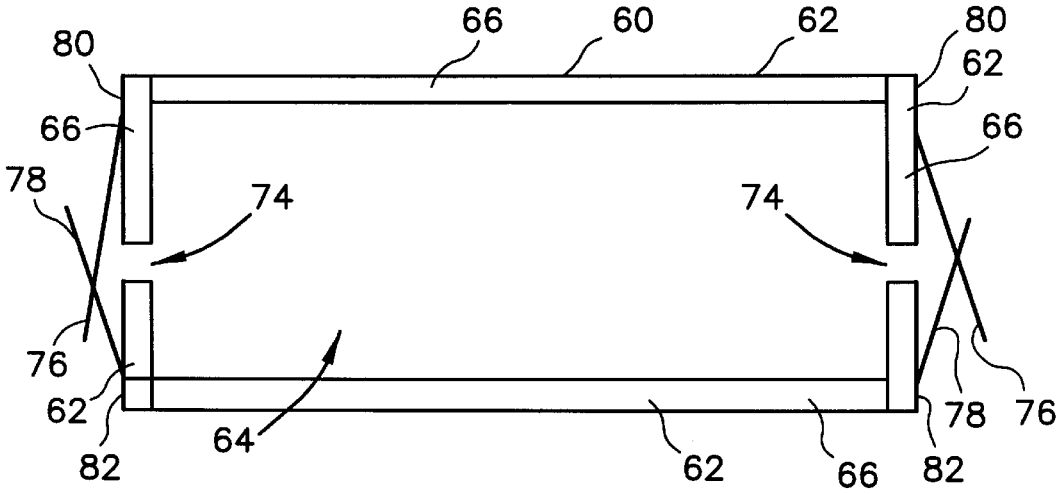
FIG. 5 is a front view of the outer edges of the sleeve structure.

Referring to FIGS. 3 and 5, an elongated length of compressible material 66, such as foam or sponge material extends substantially about outer edges 68 of the sleeve structure 60. The length of compressible or sponge material 66 is resiliently compressible inwardly against an outer surface 70 of the vehicle 14 to mold with curved portions 72 of the outer surface 70, as best illustrated in FIG. 3, to form a seal therebetween to prevent the ingress of water, debris or insects. Referring to FIG. 5, the sponge material 66 is provided in two lengths with the two lengths of sponge material 66 being in end to end spaced apart relationship with one another to form gaps 74 therebetween. The gaps 74 may be of several inches or more in width and allows space to tighten and adjust the sponge material 66 against the vehicle 14, as described below, as well as providing adjustability for vehicles of varied size.

Figure 6:
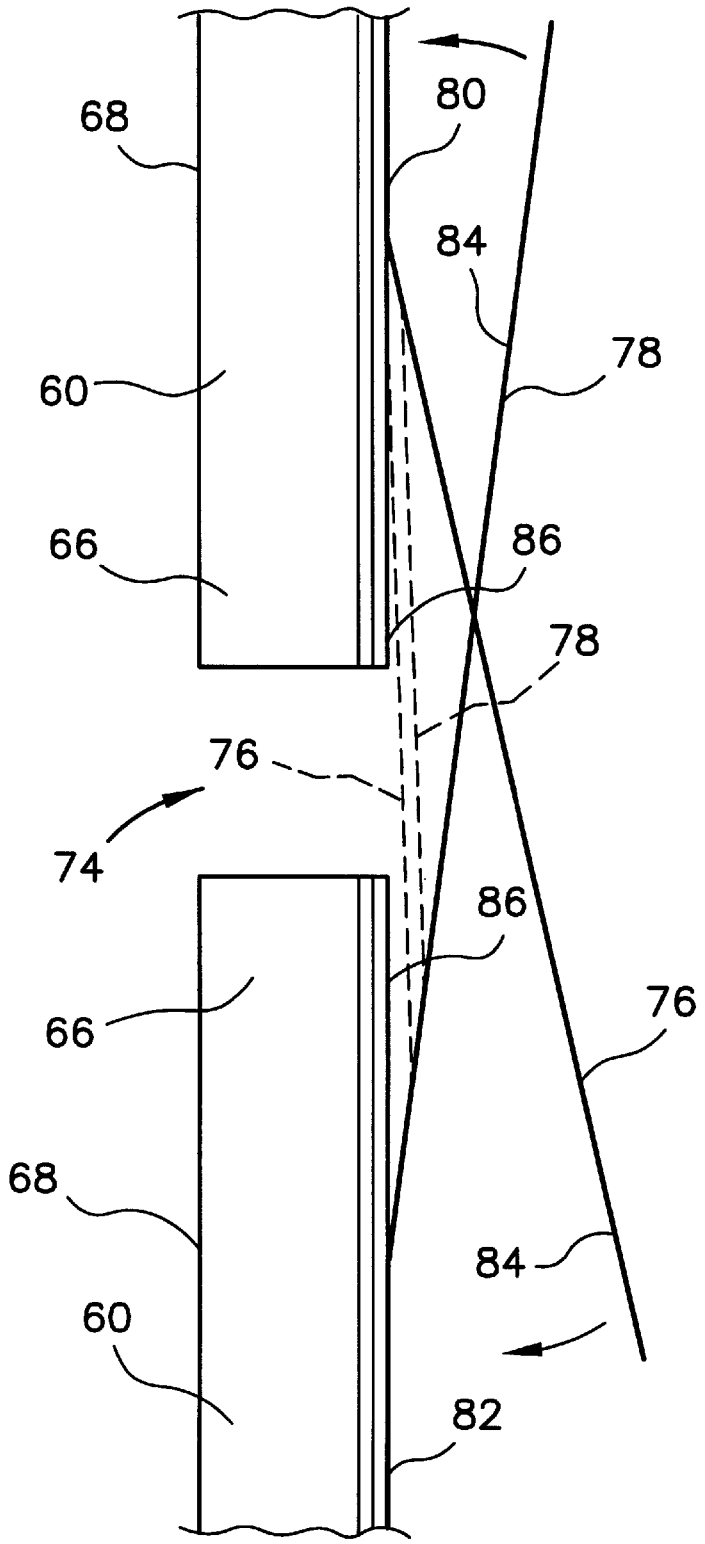
FIG. 6 is an enlarged side view of the outer edges of the sleeve structure.

Referring to FIGS. 5 and 6, first and second straps 76, 78 are provided for releasably and adjustably holding the material 66 in pressing engagement with the vehicle 14. The first strap 76 has an end 80 secured to the outer edges 68 of the sleeve structure 60 adjacent to one of two lengths of sponge material 66. The second strap 78 has an end 82 secured to the outer edges 68 of the sleeve structure 60 adjacent to other one of the two lengths of sponge material 66. In one preferred embodiment, the first and second straps 76,78 each include hook and loop fastening structures 84 secured thereto. The first and second straps 76,80 each being extendible across the gap 74 and parallel to one another for releasable engagement with corresponding mating hook and loop fastening structures 86 connected to the sleeve structure 60. In use, a single user can then grasp each strap 76,78 and by pulling each strap towards one another in a crossing fashion can cinch the sleeve structure 60 in engagement with the vehicle 14.

Referring to FIG. 2, an alternative embodiment is illustrated where first and second straps 88,90 have respective ends 92,94 connected with the sleeve structure at the outer edge 68 with opposite ends 96,98 of the straps 88,90 being releasably secured to one another with a buckle 100 across gap 74. It may be appreciated that other straping means could also be employed in accordance with the teachings of the present invention.

Referring to FIG. 3, a preferred embodiment of the construction of the outer edge 68 of the sleeve structure 60 is illustrated. The outer edge 68 includes several layers of material as hereafter described with are sewn to one another or secured by other suitable means. A hook and loop fastening structure 86 is provided for mated attachment with straps 76,78 as previously described. Two layers 102 of covering material 34 are provided and may be formed by folding over an edge of the covering material 34. An elastic band 104 is secured between the two layers 102 and provides clinching of the outer edge 68 to provide resilient flexing and tightening of the sleeve structure 60. The compressible material 66 is secured therebelow and in one preferred embodiment has cross section dimensions along its length approximately of 2"×1½".

Figure 9:
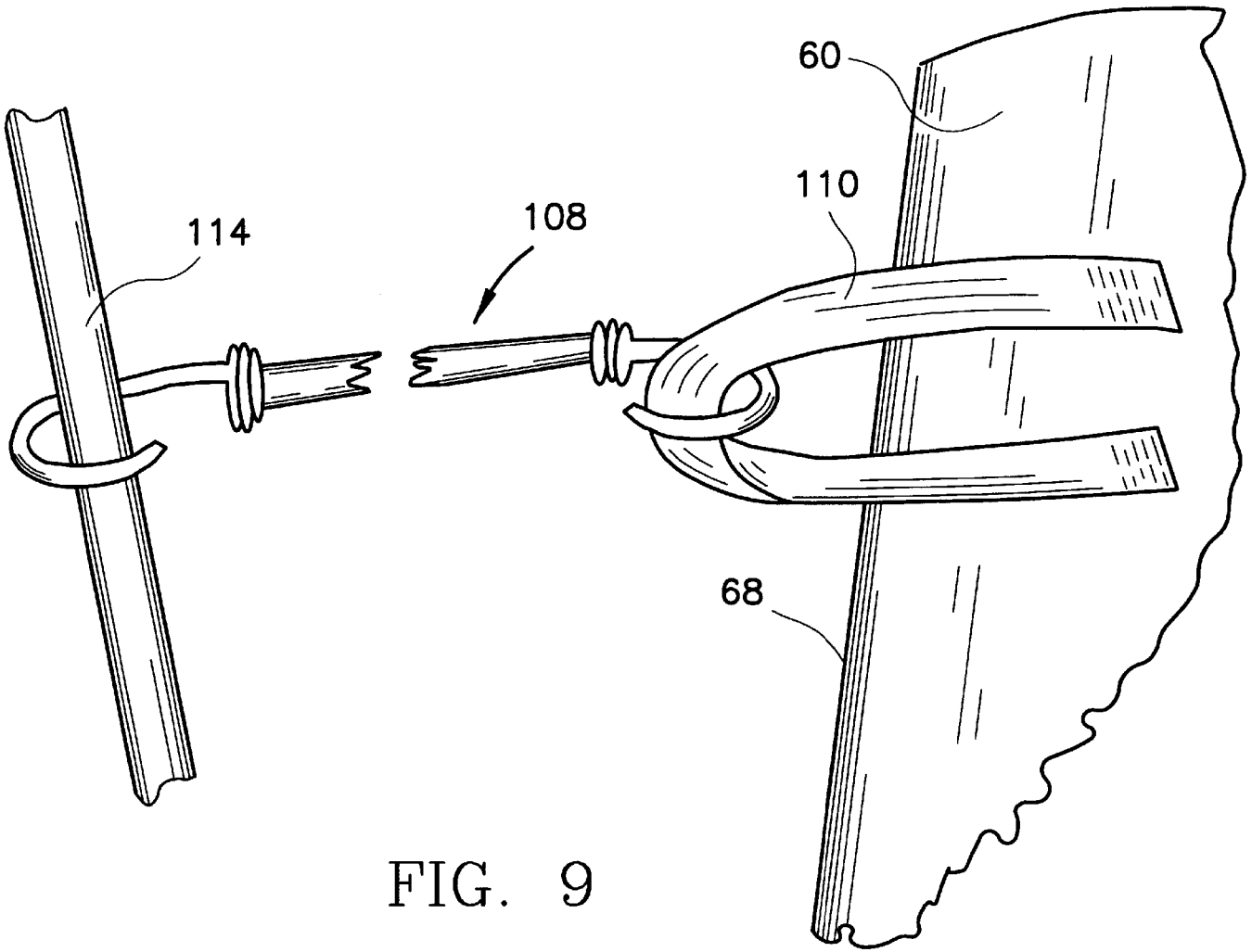
FIG. 9 is an enlarged view of an elastic cord for use with the present invention.

Additional lengths of compressible material 66 may also be provided for being extended about the door member 24 of the vehicle 14 and around a rear bumper structure 106 of the vehicle 14, as shown in FIG. 2, to provide additional sealing between the vehicle 14 and the tent assembly 10. Further, such additional material 66 may be provided to fill any gaps 74, if any, remaining after securement of the straps 76,78 or other securing means causes compression of the outer edges 68 against the vehicle 14. Referring to FIGS. 1 and 9, elastic cords 108 are provided for connection between loops 110 attached to the sleeve structure 60 and a roof rack or bars 114 of the vehicle 14.

In accordance with a method of the present invention to provide a sealed connection with a rear portion 12 of a vehicle 14, the method includes the steps of: forming a frame 28 with a plurality of support members 26 (FIGS. 1 and 4); securing a covering material 34 with the frame 28 to enclose an area generally bordered by the frame 28; providing a sleeve structure 60 connected to the covering material 34 and extending the sleeve structure 60 outwardly from the covering material; enveloping the rear portion 12 of the vehicle 14 by moving the sleeve structure 60 in telescoping engagement therewith; and sealing the sleeve structure 60 with the vehicle by providing flexible resilient compressible material 66 (FIG. 5) along outer edges 68 of the sleeve structure 60 and a strap 76 releasable secured to the outer edges of the sleeve structure 60 for providing forces causing pressing engagement of the compressible material 66 (FIG. 3) with an outer surface 70 of the vehicle 14 to mold the compressible material 66 with curved portions 72 of the outer surface 70 to form a seal to prevent the ingress of water and insects.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A tent assembly adapted for connection with a rear portion of a vehicle, the tent assembly comprising:

(a) frame means including a plurality of support members connected to one another to form a frame;

(b) covering material removably connected with said frame means to enclose an area generally bordered by said frame means, the covering material having a generally vertically oriented back wall, the back wall having edges defining a tent opening;

(c) a sleeve structure connected to the covering material and extending about the edges of the opening, the sleeve structure having flexible sidewalls extending outwardly from the back wall, the sidewalls defining a sleeve opening adapted for enveloping the rear portion of the vehicle for removable telescoping engagement therewith;

(d) sealing means connected to outer edges of the sleeve structure for flexibly and resiliently engaging the rear portion of the vehicle so that said sealing means is compressed against the rear portion of the vehicle to form a seal to prevent the ingress of water and insects, the sealing means including an elongated length of sponge material extending substantially about the outer edges of the sleeve structure, the length of sponge material being compressible against an outer surface of the vehicle to mold with curved portions of the outer surface; and (e) strap means coupled with said sealing means for releasably and adjustably holding said sealing means in pressing engagement with the vehicle.

2. The tent assembly of claim 1, wherein the sealing means includes at least two lengths of sponge material extending substantially about the outer edges of the sleeve structure, the at least two lengths of sponge material being in end to end spaced apart relationship with one another to form a gap therebetween.

3. The tent assembly of claim 2, wherein the strap means includes first and second straps, the first strap having an end secured to the outer edges of the sleeve structure adjacent to one of the at least two lengths of sponge material, the second strap having an end secured to the outer edges of the sleeve structure adjacent to another one of the at least two lengths of sponge material.

4. The tent assembly of claim 3, wherein the first and second straps each include fastening means for securing the straps in releasable connection with one another.

5. The tent assembly of claim 3, wherein the first and second straps each include hook and loop fastening structures secured thereto, the first and second straps each being extendible across the gap and parallel to one another for releasable engagement with corresponding mating hook and loop fastening structures connected to the sleeve structure.

6. A sleeve assembly adapted for detachable interconnection between a rear portion of a vehicle and a tent structure defining an enclosure therewith to provide sealed access therebetween, the sleeve assembly comprising:

(a) a sleeve structure connected to the tent structure and extending about edges of an opening of the tent structure, the sleeve structure having flexible sidewalls extending outwardly from the tent structure, the sidewalls defining a sleeve opening adapted for enveloping the rear portion of the vehicle for removable telescoping engagement therewith; and (b) sealing means connected to outer edges of the sleeve structure for flexibly engaging the rear portion of the vehicle so that said sealing means is compressed for molding conformity with curved portions of the outer surface of the rear portion of the vehicle to form a seal to prevent the ingress of water and insects, the sealing means including an elongated length of sponge material extending substantially about the outer edges of the sleeve structure, the length of sponge material being compressible against an outer surface of the vehicle to mold with curved portions of the outer surface; and (c) strap means connected with the sleeve structure for releasably and adjustably holding said sealing means in pressing engagement with the vehicle.

7. The sleeve assembly of claim 6, wherein the sealing means includes an elongated length of sponge material extending substantially about the outer edges of the sleeve structure, the length of sponge material being compressible against an outer surface of the vehicle to mold with curved portions of the outer surface.

8. The sleeve assembly of claim 6, wherein the sealing means includes at least two lengths of sponge material extending substantially about the outer edges of the sleeve structure, the at least two lengths of sponge material being in end to end spaced apart relationship with one another to form a gap therebetween.

9. The sleeve assembly of claim 8, wherein the strap means includes first and second straps, the first strap having an end secured to the outer edges of the sleeve structure adjacent to one of the at least two lengths of sponge material, the second strap having an end secured to the outer edges of the sleeve structure adjacent to another one of the at least two lengths of sponge material.

10. The sleeve assembly of claim 9, wherein the first and second straps each include fastening means for securing the straps in releasable connection with one another.

11. The sleeve assembly of claim 9, wherein the first and second straps each include hook and loop fastening structures secured thereto, the first and second straps each being extendible across the gap and parallel to one another for releasable engagement with corresponding mating hook and loop fastening structures connected to the sleeve structure.

12. A method of providing a tent assembly adapted for sealed connection with a rear portion of a vehicle, the method comprising the steps of:

(a) forming a frame with a plurality of support members;

(b) securing a covering material with the frame to enclose an area generally bordered by the frame;

(c) providing a sleeve structure connected to the covering material and extending the sleeve structure outwardly from the covering material;

(d) enveloping a rear portion of a vehicle by moving the sleeve structure in telescoping engagement therewith; and (e) sealing the sleeve structure with the vehicle by providing flexible resilient compressible material along outer edges of the sleeve structure and a strap releasable secured to the outer edges of the sleeve structure for providing forces causing pressing engagement of the compressible material with an outer surface of the vehicle to resiliently compress and mold the compressible material with curved portions of the outer surface to form a seal to prevent the ingress of water and insects.

* * * * *